US009644924B2

(12) United States Patent
Doria

(10) Patent No.: US 9,644,924 B2
(45) Date of Patent: May 9, 2017

(54) ARCHERY BACKSTOP

(71) Applicant: TRILOGY TARGETS CREATIONS, LTD., Oregon, OH (US)

(72) Inventor: Michael Doria, Oregon, OH (US)

(73) Assignee: Trilogy Targets Creations, Ltd., Oregon, OH (US)

( * ) Notice: Subject to any disclaimer, the term of this patent is extended or adjusted under 35 U.S.C. 154(b) by 94 days.

(21) Appl. No.: 14/578,770

(22) Filed: Dec. 22, 2014

(65) Prior Publication Data

US 2015/0198425 A1 Jul. 16, 2015

Related U.S. Application Data

(60) Provisional application No. 61/925,705, filed on Jan. 10, 2014.

(51) Int. Cl.
*F41J 1/10* (2006.01)
*F41J 3/00* (2006.01)

(52) U.S. Cl.
CPC ..... *F41J 3/0004* (2013.01); *F41J 1/10* (2013.01)

(58) Field of Classification Search
CPC ..... F41J 1/14; F41J 7/00; F41J 13/00; F41J 1/10; F41J 11/00; A63B 63/00
USPC ..... 273/402, 403, 404, 406, 407, 410
See application file for complete search history.

(56) References Cited

U.S. PATENT DOCUMENTS 5,829,753 A * 11/1998 Wiser ..... F41J 1/10 273/407
5,865,439 A * 2/1999 Marcuson, III ..... F41J 7/06 273/391
6,543,778 B2 * 4/2003 Baker ..... F41J 7/00 273/403
7,434,810 B2 * 10/2008 DeMille ..... A63F 9/0204 273/403
7,959,154 B2 * 6/2011 Ball ..... F41J 1/10 273/407
7,967,296 B1 * 6/2011 Halverson ..... F41J 11/00 273/404
2006/0125186 A1 * 6/2006 Digges ..... A63B 67/06 273/402
2011/0233870 A1 * 9/2011 Oh ..... F41J 13/00 273/410

* cited by examiner

*Primary Examiner* — Aarti B Berdichevsky
*Assistant Examiner* — Christopher Glenn
(74) *Attorney, Agent, or Firm* — Ward Law Office LLC; Jacob M. Ward

(57) ABSTRACT

An archery backstop includes a collapsible frame used to receive a front board and a rear board. The front board is formed from a medium density fiberboard while the rear board is formed from an extruded polystyrene insulation. The frame is collapsible about a pair of hinges formed on the frame, allowing the frame to be folded in half when transported. A pair of magnetic locks disposed on the frame maintains the backstop in a collapsed position, while a rotatable locking mechanism disposed on the frame maintains the frame in an open position during use. The frame further includes an adjustable hanger bar support to allow for various configurations and placements of a target to be attached to the backstop.

8 Claims, 12 Drawing Sheets

ARCHERY BACKSTOP

CROSS-REFERENCE TO RELATED APPLICATIONS

This application claims the benefit of U.S. Provisional Application Ser. No. 61/925,705, filed on Jan. 10, 2014. The entire disclosure of the above application is hereby incorporated herein by reference.

FIELD

The present disclosure relates to a portable archery backstop.

BACKGROUND

It is customary when practicing archery to provide a backstop behind the desired target to both prevent the loss of arrows while also maintaining the safety of any persons or property that may be behind the target. However, one problem associated with such backstops is that the arrows shot at the backstop are commonly damaged during the impact with the backstop or during the removal of the arrow from the backstop. One solution to this problem has been to provide a soft backstop that allows the arrow to easily pierce the backstop during impact. Unfortunately, such backstops are easily damaged due to repeated piercings. Furthermore, such a backstop is a safety hazard because of the likelihood of an arrow striking an object on the other side of the backstop, due to the ease with which the arrows pierce the backstop or the formation of holes in the backstop from repeated use.

Another problem associated with known backstops is that they are not easily adaptable to differing conditions. The backstop may be difficult to assemble, disassemble, or carry, making transport of the backstop from one location to another undesirably difficult and frustrating. Furthermore, many backstops do not have adjustability to accommodate for targets of varying dimensions or different methods of mounting the target.

There is a continuing need for an archery backstop that militates against the loss and damage of arrows, while also presenting an ease of adjustability and transport.

SUMMARY

In concordance with the instant disclosure, an archery backstop that militates against the loss and damage of arrows, while also presenting an ease of adjustability and transport, is surprisingly discovered.

In one embodiment, an archery backstop includes a frame, a pair of bar supports, and a bar. The frame is used to receive at least one board therein. The bar supports extend outwardly from and are coupled to the frame. The bar is disposed between the bar supports. The bar has at least one connector for holding and adjusting a position of an archery target on the bar and in front of the frame.

In another embodiment, a method of using an archery backstop includes a step of positioning at least one board within a frame. A pair of bar supports are then extended outwardly from and coupled to the frame. A bar is mounted between the bar supports and at least one connector is provided on the bar for holding an archery target in front of the frame. The bar supports permit horizontal spacing of the target on the frame.

In a further embodiment, a kit for an archery backstop includes a frame, a pair of bar supports, a hinge, a pair of magnetic locking devices, and a locking mechanism. The frame is used to receive at least one board therein. The frame is divisible into each of a first frame member and a second frame member. The bar supports extend outwardly from and are coupled to the frame. The hinge is positioned between the first frame member and the second frame member, and allows the first frame member to rotate with respect to the second frame member from an open position to place the first and the second frame members into the collapsed position. The magnetic locking devices cooperate to secure the frame in the collapsed position. The locking mechanism releasably secures the frame in the open position. The frame holds an archery target while in the open position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1A:
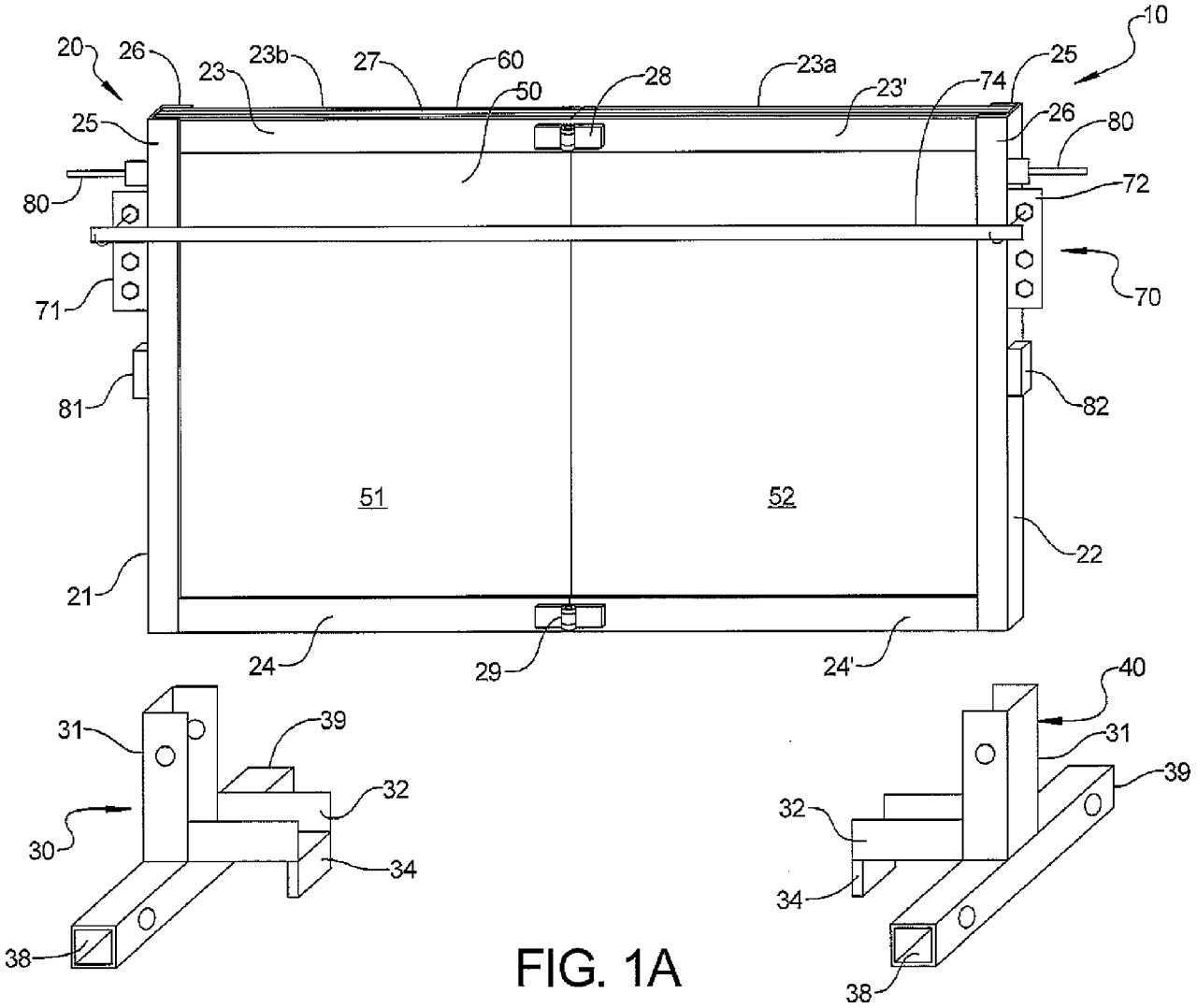
FIG. 1A is a front perspective view of an archery backstop according to the current disclosure, the archery backstop shown separated from the supports for purposes of illustration.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Additionally, the dimensions provided in the drawings are merely for purposes of explaining the invention, and are not necessary or critical to operation of the invention unless otherwise stated herein. In respect of the methods disclosed, the steps presented are exemplary in nature, and thus, the order of the steps is not necessary or critical unless otherwise disclosed.

Figure 2:
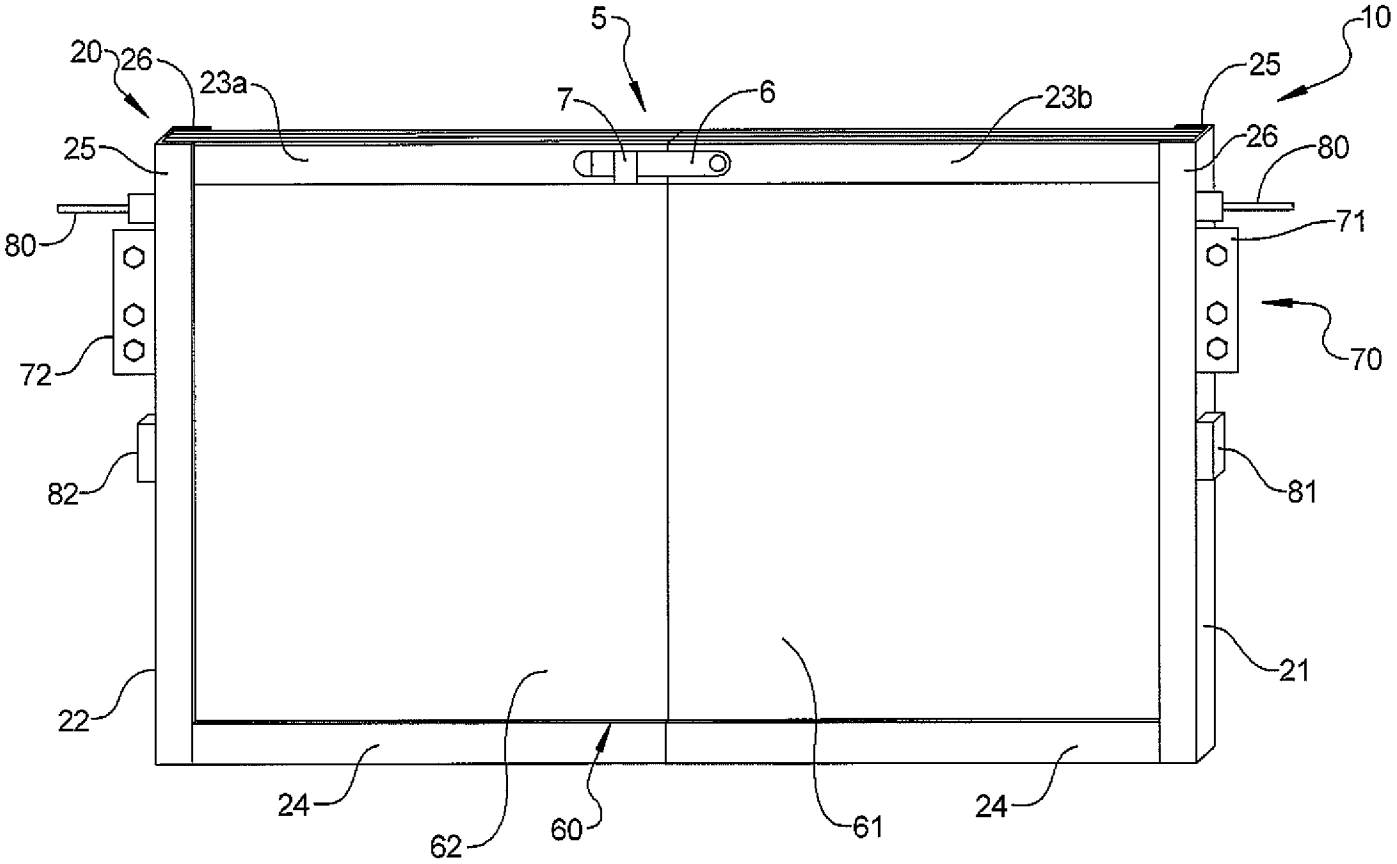
FIG. 2 is a rear perspective view of the archery backstop illustrated in FIG. 1A.

FIGS. 1A and 2 illustrate an archery backstop 10. The archery backstop 10 has a frame 20, a first support 30, and a second support 40. The frame 20 is used to receive both a front board 50 (shown in FIG. 1A) and a rear board 60 (shown in FIG. 2).

The frame 20 includes a first side member 21 and a second side member 22. Each of the first side member 21 and the second side member 22 are elongated C-channels arranged vertically with respect to a ground surface. Each of the first side member 21 and the second side member 22 has a length slightly greater than a height of each of the front board 50 and the rear board 60, for example. Each C-channel forming the first and second side members 21, 22 includes a pair of projections 25, 26 extending transversely from a central piece of material, where a space between the projections 25, 26 should be slightly larger than a combined thickness of the front board 50 and the rear board 60 when disposed adjacent one another and inserted within the frame 20. A side of each C-channel having the projections 25, 26 extending therefrom represents an open side of each C-channel. The open side of the first side member 21 is arranged opposite and in facing relationship to the open side of the second side member 22. The first side member 21 is spaced apart from the second side member 22 a distance slightly larger than a width of either of the front board 50 and the rear board 60.

Each of the first side member 21 and the second side member 22 may include apertures (not shown) formed therein for securing the front board 50 and the rear board 60 within the frame 20. The apertures may be formed in the projecting portions 25, 26 such as in each of the projections 25, 26 of the C-channels forming the first side member 21 and the second side member 22. Accordingly, each of the front board 50 and the rear board 60 may include corresponding apertures (not shown) formed adjacent a peripheral edge thereof. When the boards 50, 60 are placed in the frame 20, the boards 50, 60 may be moved to align the apertures formed therein with the apertures formed in the first and second side members 21, 22. A cross-pin may then be placed through the apertures, securing a position of the boards 50, 60 relative to the frame 20 when the boards 50, 50 are together inserted in the C-channels of the frame 20.

A pair of upper frame members 23, 23' are disposed between and extend from the open side of each of the first side member 21 and the second side member 22. One upper frame member 23 contacts a projection 25, and upper frame member 23' contacts projection 26, for example. Each upper frame member 23, 23' is a thin elongated piece of material having a generally rectangular shape. Each upper frame member 23, 23' is coupled to a corresponding side member 21, 22 adjacent an upper end thereof by a conventional coupling means, such as welding as a nonlimiting example. A space between each pair of upper frame members 23, 23' is also slightly larger than a combined width of the front board 50 and the rear board 60, in order to permit the front board 50 and the rear board 60 to be inserted together into the frame 20.

Each upper frame member 23, 23' extends about half of the distance between the first side member 21 and the second side member 22. One of the upper frame members 23 extending from the first side member 21 is rotatably coupled to another one of the upper frame members 23' extending from the second side member 22 by means of an upper first hinge 28.

As shown in FIG. 2, the upper frame members 23 can further include an upper frame member 23*a* disposed opposite an upper frame member 23*b*. The upper frame members 23*a*, 23*b* are releasably coupled to each other using a locking mechanism 5. As a nonlimiting example, the locking mechanism 5 may include a switch 6 that is rotatably coupled to one of the upper frame members 23*b* at a first end thereof. When the switch 6 is rotated to be aligned with and parallel to the upper frame members 23*a*, 23*b*, a second end of the switch 6 will be retained by a clip 7 formed on the other one of the upper frame members 23*a* opposite of the upper first hinge 28. The switch 6 secures the frame 20 in a flattened and unfolded position when retained by the clip 7.

A pair of lower frame members 24, 24' are disposed between and extend from the open side of each of the first side member 21 and the second side member 22 similar to the upper frame members 23, 23'. One lower frame member 24 contacts the projection 25, and the lower frame member 24' contacts the projection 26, for example. Each lower frame member 24, 24' is a thin elongated piece of material having a generally rectangular shape. Each lower frame member 24, 24' is coupled to one of the corresponding side members 21, 22 adjacent a lower end thereof by a conventional coupling means, such as welding as a non-limiting example. A space between each pair of lower frame members 24, 24' is also slightly larger than a combined width of the front board 50 and the rear board 60, in order to permit the front board 50 and the rear board 60 to be inserted together into the frame 20.

Each lower frame member 24, 24' extends about half of the distance between the first side member 21 and the second side member 22. One of the lower frame members 24 extending from the first side member 21 is rotatably coupled to another one of the lower frame members 24' extending from the second side member 22 by means of a lower second hinge 28.

Alternatively, the lower frame members 24 may be C-channels similar to the first and second side members 21, 22, where the addition of the central connecting portion of each C-channel is used to aid in supporting the front and rear boards 50, 60 when the boards 50, 60 are installed in the frame 20.

Figure 1B:
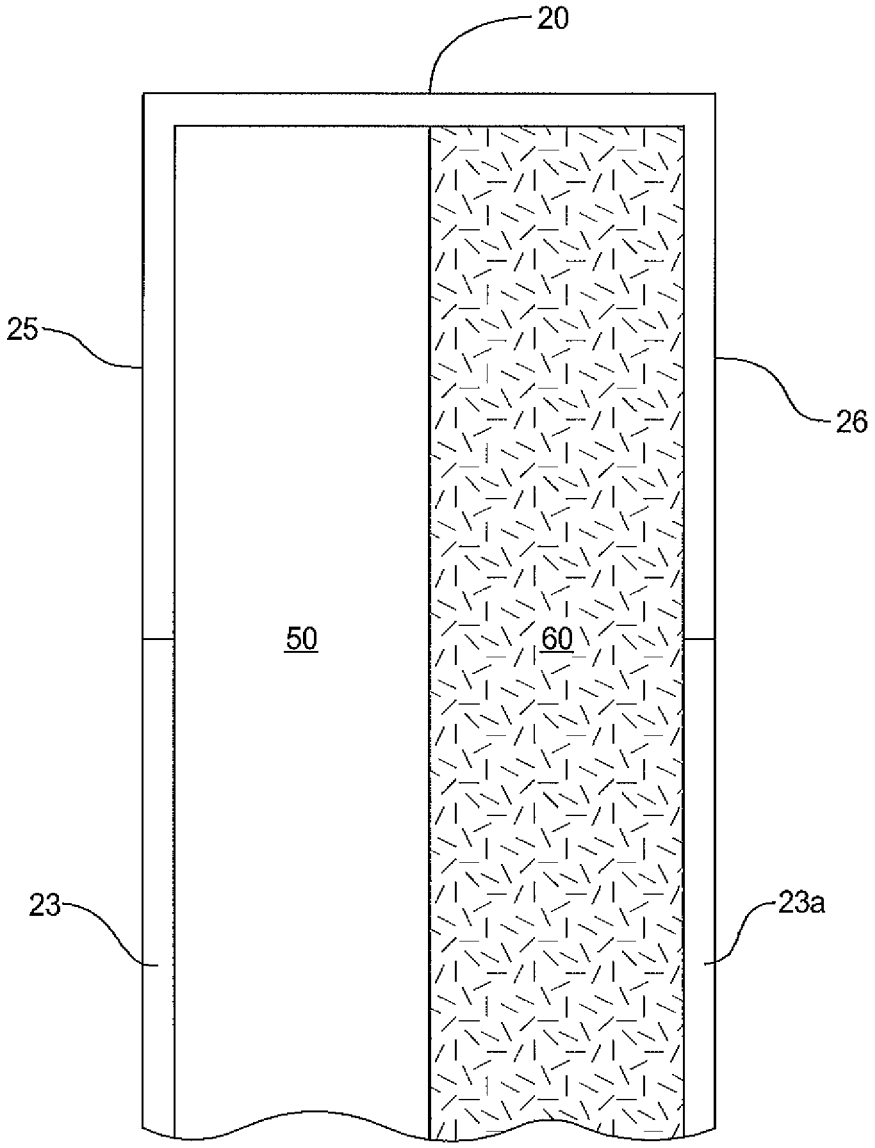
FIG. 1B is a top plan view of a portion of the archery backstop illustrated in FIG. 1A, and showing both the front board and the rear board.

As shown in FIGS. 1A and 1B, the first side member 21, the second side member 22, the upper frame members 23, and the lower frame members 24 cooperate to form a rectangular frame 20 having dimensions suitable for receiving both the front board 50 and the rear board 60 simultaneously. The boards 50, 60 may be received in an opening 27 formed along an upper surface of the frame 20 by the cooperation of the upper ends of the first and second side members 21, 22 and the upper frame members 23 extending therebetween.

Figures 4A, 4B:
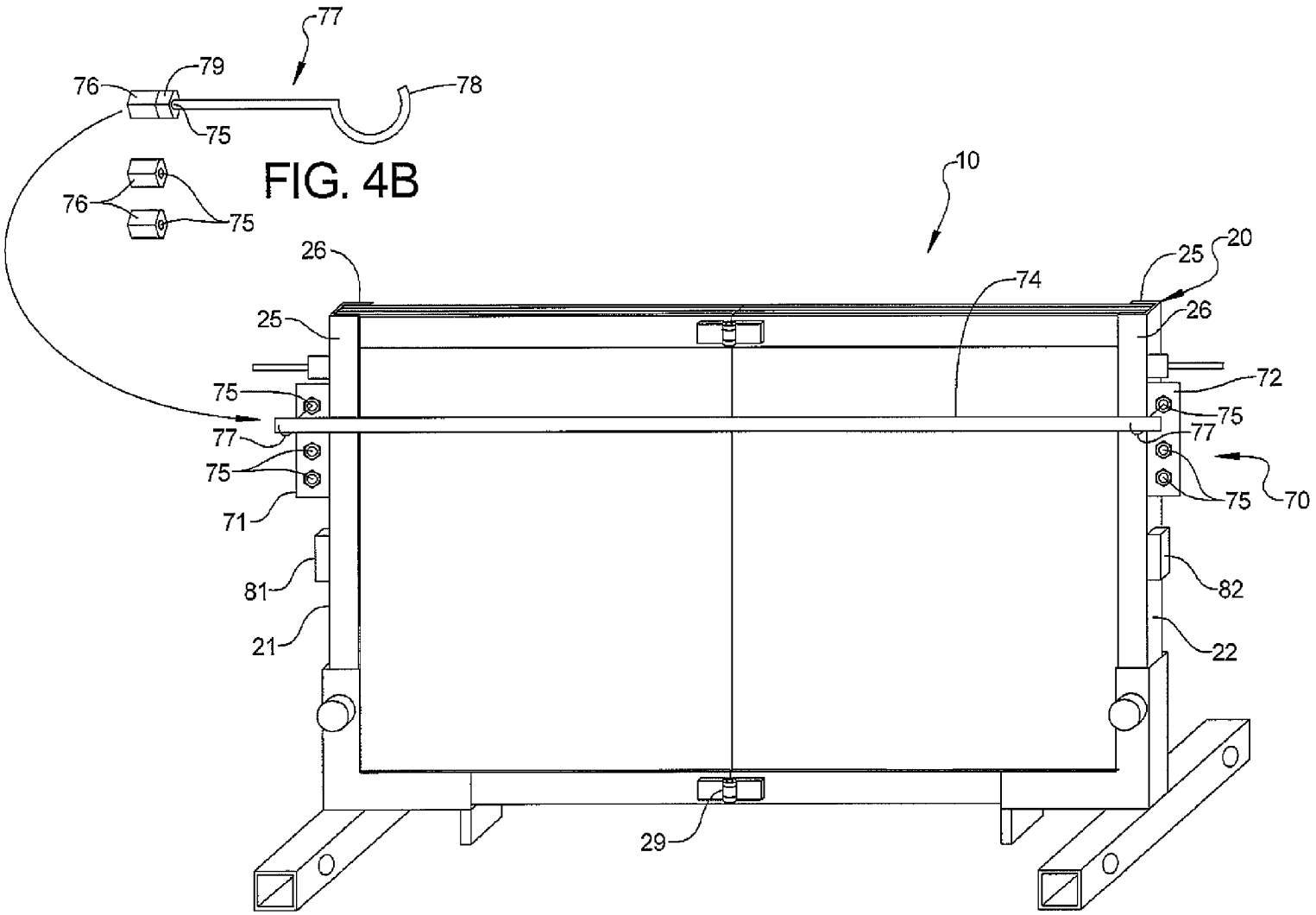
FIG. 4A is a perspective view of the archery backstop of FIGS. 1A and 2 illustrating an adjustable support bar according to the current disclosure, the archery backstop shown together with the supports for purposes of illustrations.
FIG. 4B is a front elevational view of a hook and nut assembly used for retention of the rod of FIG. 4A.
Figure 5:
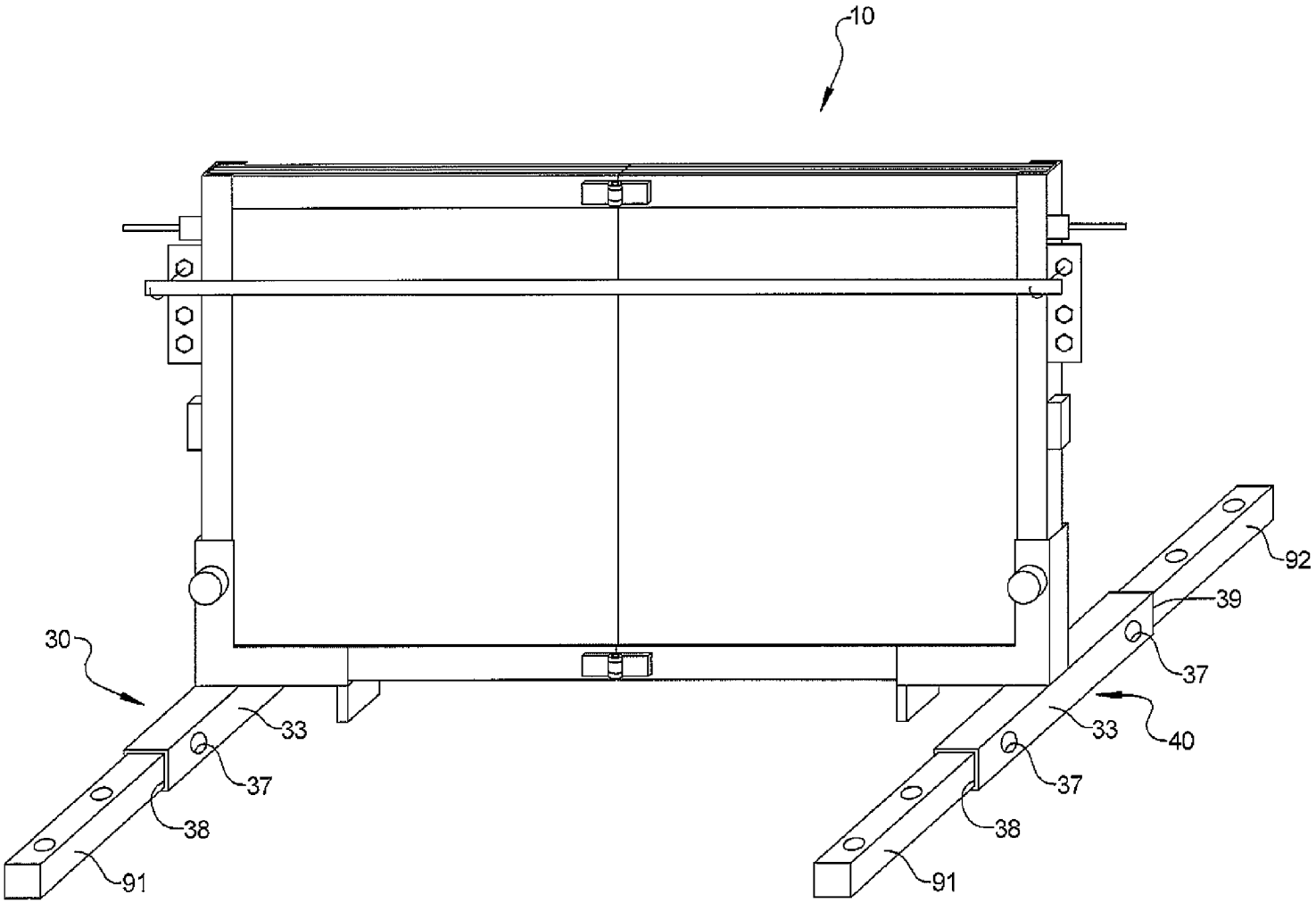
FIG. 5 is a perspective view of the archery backstop of FIGS. 1A and 2 also including support tubes for stabilizing the archery backstop.
Figure 6:
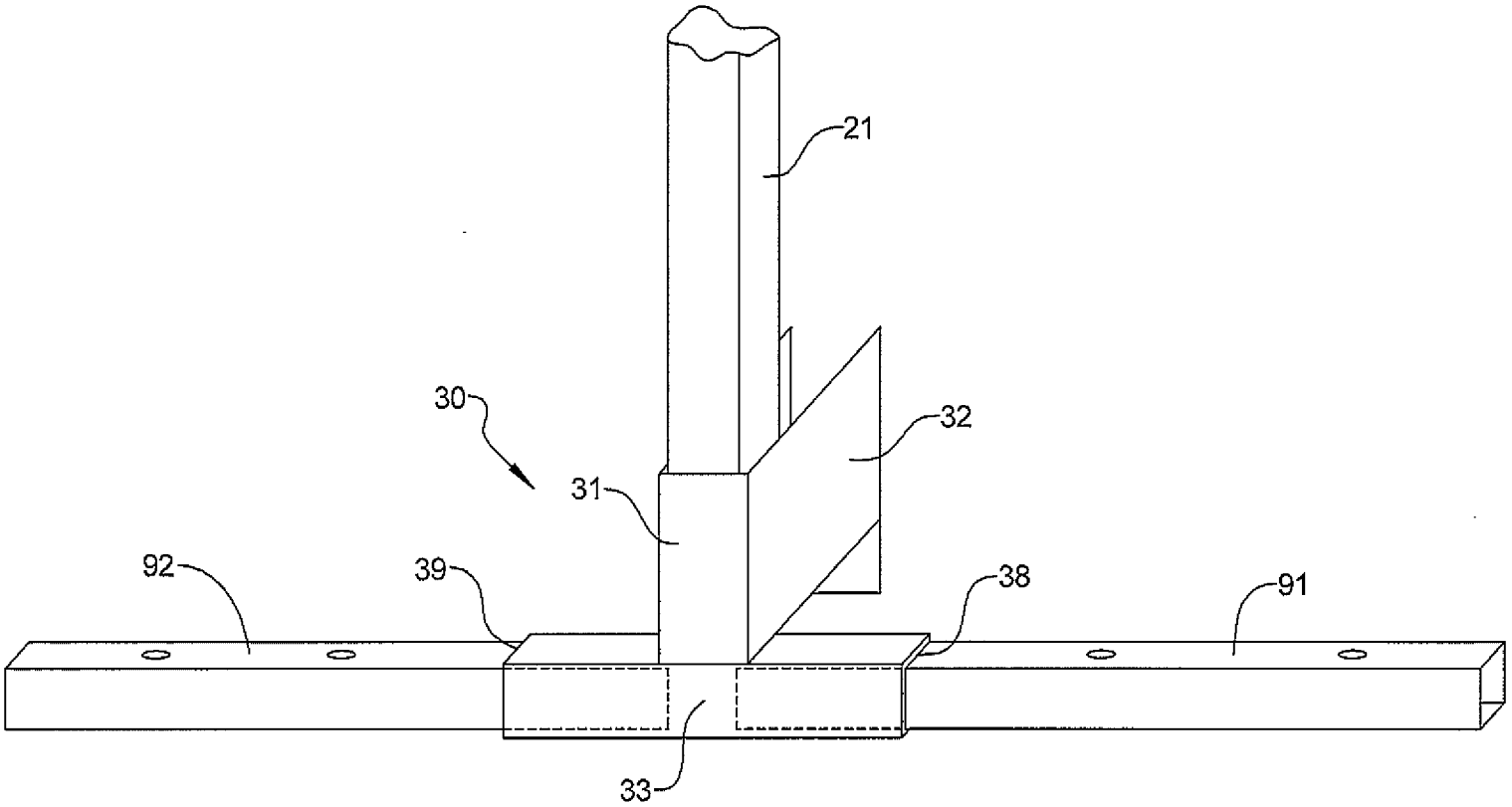
FIG. 6 is a left side partial perspective view showing an arrangement of a support and a frame forming the archery backstop.
Figure 7:
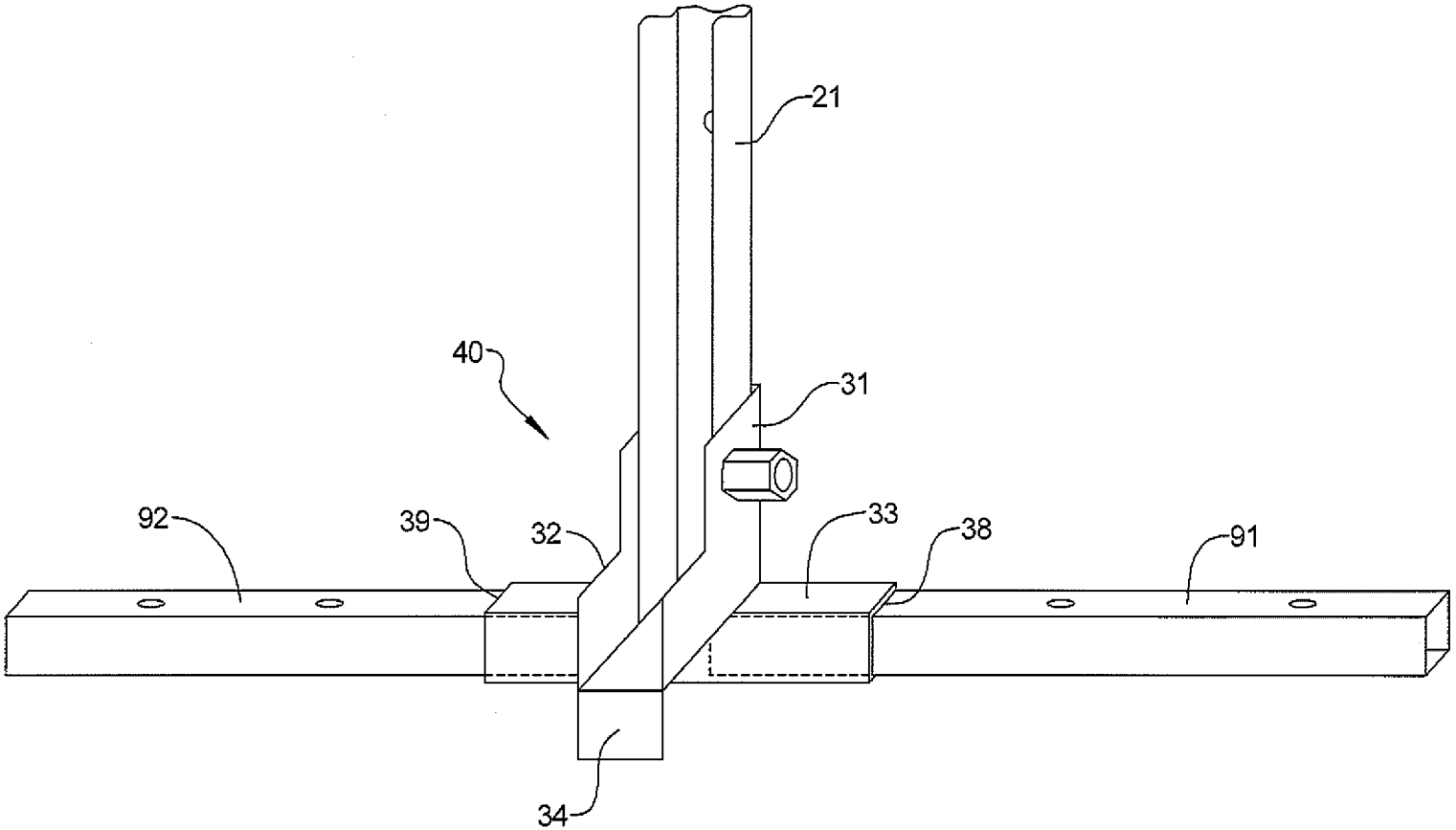
FIG. 7 is a right side partial perspective view showing an interior of the arrangement of the support and the frame of FIG. 6.
Figure 9:
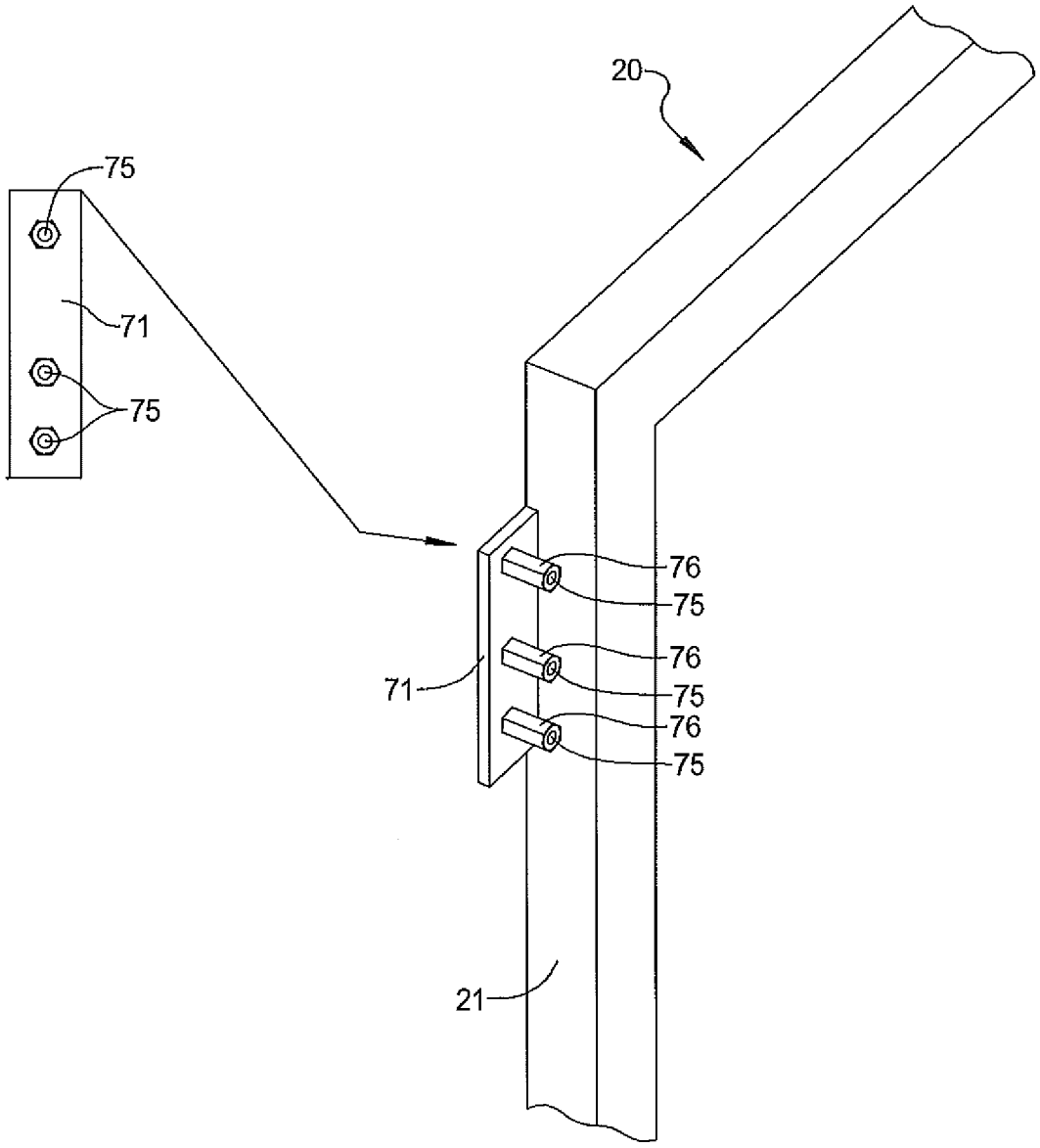
FIG. 9 is an enlarged perspective view illustrating a bar support according to the current disclosure.
Figure 10:
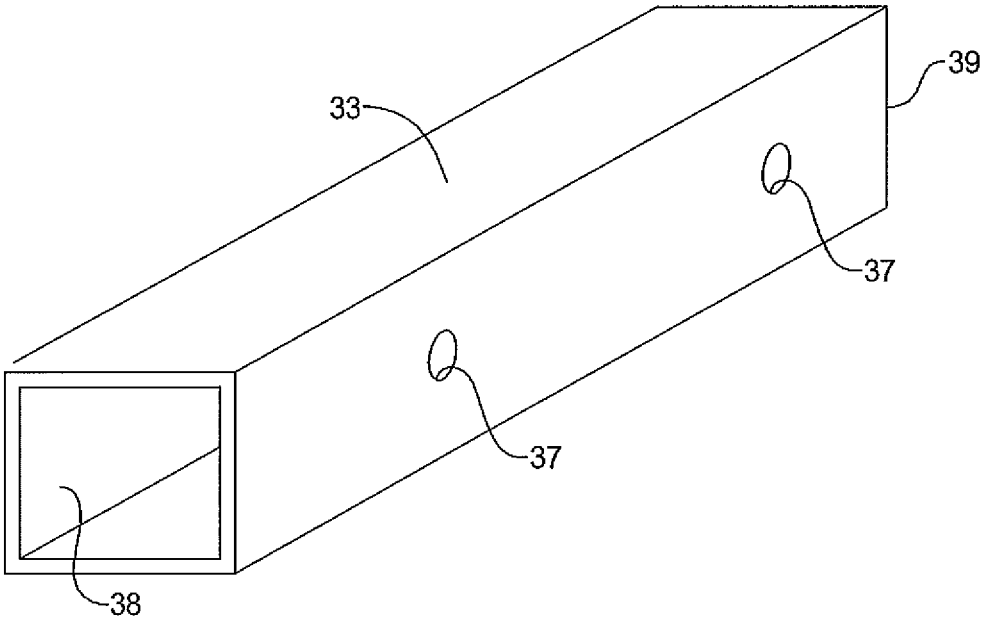
FIG. 10 is a perspective view of a portion of the supports illustrated in FIG. 3.

Referring now to FIGS. 4A, 4B, and 9, the frame 20 may further include an adjustable hanger bar support 70. The adjustable hanger bar support 70 includes a first bar support 71 connected to the first side member 21 and a second bar support 72 connected to the second side member 22. According to several embodiments, the first bar support 71 is a flange extending in a direction away from the second side member 22 while the second bar support 72 is a flange extending in a direction away from the first side member 21. The first bar support 71 may be rigidly coupled to a closed side of the C-channel forming the first side member 21 while the second bar support 72 may be rigidly coupled to a closed side of the C-channel forming the second side member 22. Both the first bar support 71 and the second bar support 72 have a longitudinal axis extending vertically and parallel to the first and second side members 21, 22.

Each of the first bar support 71 and the second bar support 72 includes a plurality of apertures 75 formed therein. The apertures 75 are spaced apart and arranged in a direction of the longitudinal axis of each of the first bar support 71 and the second bar support 72. The apertures 75 may be formed, for example, in nuts 76 protruding from and fixed to a surface of the bar supports 71, 72. The apertures 75 formed in the nuts 76 may have a threaded interior surface for receiving a hook 77 therein. With specific reference to FIG. 9, and again to FIG. 1A, the multiple positions provided by the multiple nuts 76 provide multiple selectable height positions for attachment of the bar 74. As shown more specifically in FIG. 4B, the hook 77 includes a retaining end 78 and a threaded end 79. The threads of the threaded end 79 of the hook 77 are adapted to cooperate with the threads formed in the apertures 75, allowing the hook 77 to be releasably coupled to the apertures 75 formed in the first and second bar supports 71, 72. The retaining ends 78 of the hooks 77 cooperate to support a bar 74 that extends along a width of the frame 20. The bar 74 has a length at least equal to and according to several embodiments greater than a width of the frame 20 when the frame 20 is fully assembled and in an open position. The bar 74 may be formed from rigid tubing, but it should be understood that any suitable material may be used.

Referring again to FIGS. 1A and 2, the frame 20 may further include a pair of carrying handles 80. Each carrying handle 80 is an elongate rod extending from the closed side of each of the first side member 21 and the second side member 22. Each carrying handle 80 may also be releasably coupled to the frame 20. Each carrying handle 80 may for instance include a threaded end that cooperates with a threaded aperture (not shown) formed in the closed side of each of the first side member 21 and the second side member 22, allowing a user to remove each carrying handle 80 when desired. As shown in FIG. 1, the carrying handles 80 may be disposed on the first and second side members 21, 22 above the adjustable hanger bar support 70.

The frame 20 may also include a first magnetic lock 81 connected to the first side member 21 and a second magnetic lock 82 connected to the second side member 22. The first and second magnetic locks 81, 82 may be disposed along a central portion of the corresponding first and second side members 21, 22, but it should be understood that any placement of the first and second magnetic locks 81, 82 that results in the first and second magnetic locks 81, 82 being aligned when the frame 20 is folded about the upper and lower hinges 28, 29 may be used. The first and the second magnetic locks 81, 82 are oppositely magnetized to attract to each other when brought in alignment and close proximity to each other with the frame in a folded or closed position shown and described in greater detail in FIG. 8.

Although the frame 20 is shown and described herein primarily in relation to a collapsible or foldable embodiment having the upper and the lower hinges 28, 29, one of ordinary skill in the art should appreciate that the frame 20 of the present disclosure may alternatively be in the form of a single, unitary frame that is not collapsible or foldable, as desired.

As further shown in FIG. 1A, the frame 20 is supported by the cooperation of a first support 30 corresponding to the first side member 21 and a second support 40 corresponding to the second side member 22. The first support 30 and the second support 40 are identical in structure, hence only the structure of the first support 30 is described in detail herein.

Referring to FIG. 3 and again to FIG. 1A, the first support 30 is formed from a first portion 31, a second portion 32, and a third portion 33. The first portion 31 and the second portion 32 are C-channels arranged perpendicular to each other to form an L-shape, where the first portion 31 extends vertically and the second portion 32 extends horizontally. A pair of outer projecting portions of each C-channel are spaced apart slightly larger than that of the first side member 21 to allow the first support 30 to receive the frame 20 therein when the archery backstop 10 is assembled. An open side of the first portion 31 faces in a direction that the second portion 32 extends longitudinally while an open side of the second portion 32 faces upwardly in a direction that the first portion 31 extends longitudinally, forming an interior corner for receiving one corner of the frame 20. The second portion 32 is rigidly coupled to the first portion 31 at a first end thereof, such as by welding, while a second end thereof includes a flange 34 arranged perpendicular and downward from a longitudinal axis of the second portion 32. The flange 34 adds additional support and stiffness to the first support 30 at the second portion 32. The flange 34 extends a distance downward equal to a height of the third portion 33.

Figure 3:
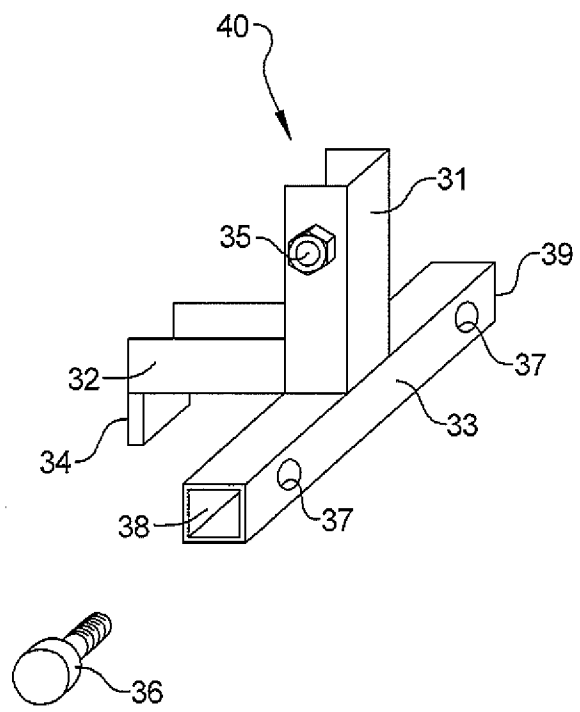
FIG. 3 is a perspective view of first and second supports used with the archery backstop illustrated in FIGS. 1A and 2.
Figure 3:
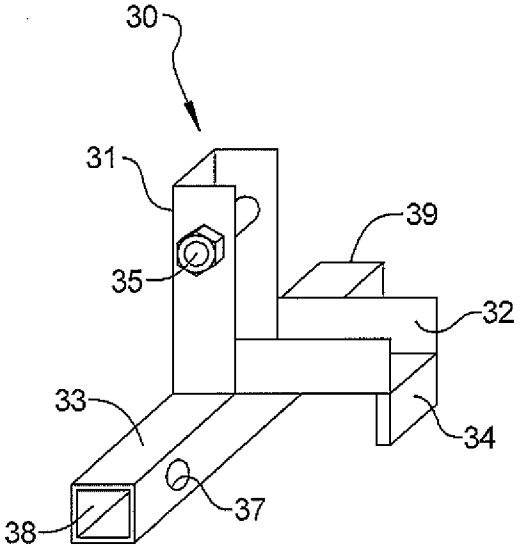

The first portion 31 may include at least one aperture 35 most clearly visible in FIG. 1A, formed in one or both of the projecting portions of the C-channel forming the first portion 31. Each aperture 35 is dimensioned to receive a threaded shank of a thumb knob 36 having a corresponding dimension. As shown in FIG. 3, each aperture 35 may be formed in a nut extending from a surface of the first portion 31. Furthermore, each aperture 35 may include a threaded interior surface for receiving the threaded shank of the thumb knob 36, which may have corresponding threads formed thereon for cooperating with the threads formed in each aperture 35. The at least one aperture 35 may be formed adjacent a first longitudinal end of the first portion 31 opposite a second end thereof that is rigidly coupled to the second portion 32.

A longitudinal axis of the third portion 33 is arranged perpendicular to the longitudinal axes of both the first portion 31 and the second portion 32. The third portion 33 extends laterally to each side of the L-shaped coupling of the first and second portions 31, 32 to add support to the archery backstop 10. The first and second portions 31, 32 are rigidly coupled to the third portion 33 on a top surface thereof and at a midpoint thereof, such as by welding. In contrast to the first and second portions 31, 32, which are formed from a C-channel with an open side, the third portion 33 is formed from square or rectangular tubing having a channel formed therein extending from an open first end 38 of the third portion 33 to an open second end 39 of the third portion 33. The third portion 33 may also include at least one aperture 37 formed in each sidewall thereof to each side of the first and second portions 31, 32. As mentioned hereinabove, the third portion 33 has a height equal to that of the flange 34 to allow the second portion 32 to extend in a direction parallel to a ground surface supporting the archery backstop 10.

Figure 11:
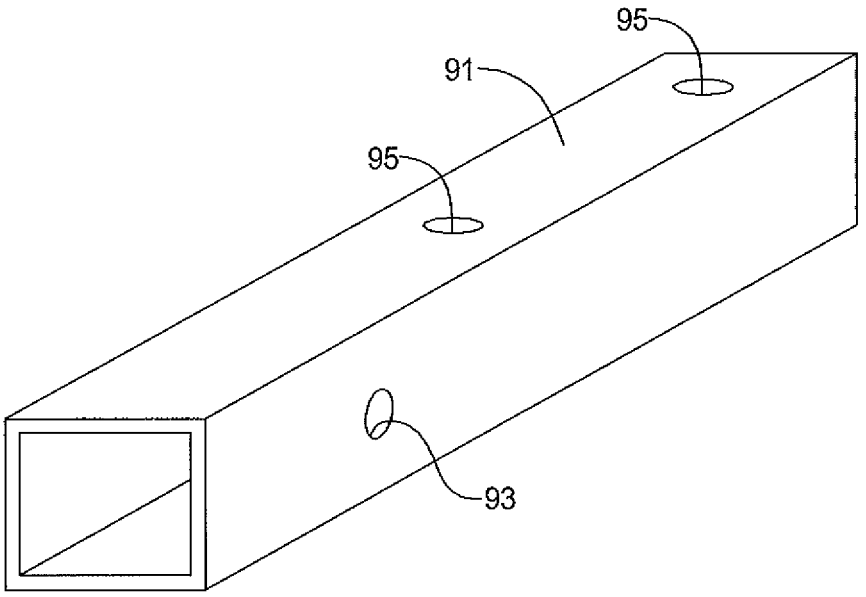
FIG. 11 is a perspective view of one support tube used to add stability to the archery backstop.
Figure 12:
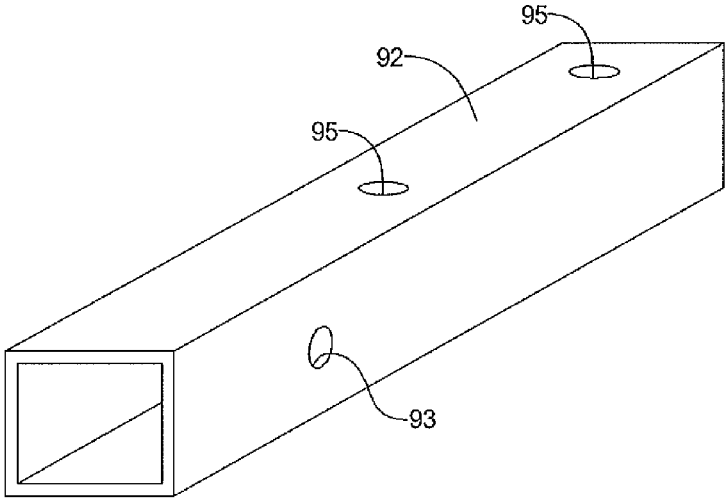
FIG. 12 is a perspective view of another support tube used to add stability to the archery backstop.

As shown in FIGS. 5-7 and 10-12, the third portion 33 of the first support 30 is configured to receive a first support tube 91 and a second support tube 92 (second support tube 92 is only visible extending from the third portion 33 of the second support 40 in this view) therein. The first support tube 91 is slidably received in the open first end 38 of the third portion 33 while the second support tube 92 is slidably received in the open second end 39 of the third portion 33. As shown in FIGS. 11 and 12, each of the first support tube 91 and the second support tube 92 includes an aperture 93 formed in each sidewall thereof. The apertures 93 formed in the first and second support tubes 91, 92 are configured to cooperate with the apertures 37 formed in the sidewalls of the third portion 33 to secure the first and second support tubes 91, 92 to the first support 30. A pair of retaining pins (not shown) are fed through the apertures 37, 93 when the apertures 37, 93 are aligned to releasably couple the first and second support tubes 91, 92 to the third portion 33 of the first support 30.

As shown in FIG. 11, each of the first support tube 91 and the second support tube 92 also includes at least one aperture 95 formed in both an upper wall and a lower wall thereof. The apertures 95 formed in the upper wall are aligned with the apertures 95 formed in the lower wall to allow a retaining device (not shown) to be fed through the apertures 95 to secure a position of the first support 30 to a ground surface.

The front board 50 may be formed from a medium density fiberboard while the rear board 60 is formed from an extruded polystyrene insulation. The rear board 60 may for instance be formed from Foamular® boards produced by Owen Corning. As should be understood, each of the front board 50 and the rear board 60 may be formed from a two-piece construction to allow the frame 20 to be folded when the front board 50 and the rear board 60 are received within the frame 20. Accordingly, as shown in FIG. 1A, the front board 50 may be divided into two equal halves in the form of a first portion 51 and a second portion 52.

Similarly, as shown in FIG. 2, the rear board 60 may be divided into two equal halves in the form of a first portion 61 and a second portion 62. It should be understood that any suitable materials may be used to form either of the front board 50 and the rear board 60. It should also be understood that the archery backstop 10 may be used with only one of the front board 50 and the rear board 60, or the front and rear boards 50, 60 may be securely coupled to each other before being received in the frame 20.

Figure 8:
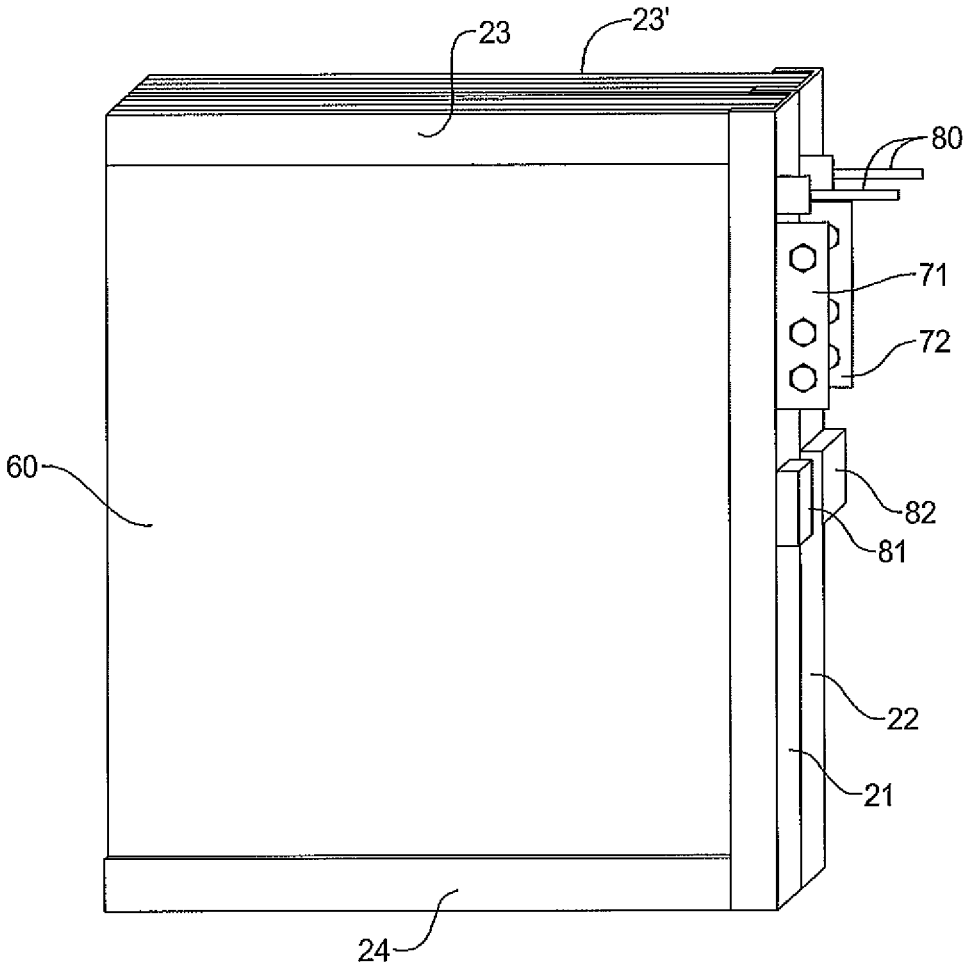
FIG. 8 is a perspective view showing the frame of the archery backstop in a collapsed position.

In use, the archery backstop 10 may first be in a folded or collapsed position as shown in FIG. 8. When in the collapsed position, the frame 20 is rotated about the upper hinge 28 and the lower hinge 29 to essentially fold the frame 20 in half lengthwise. The first magnetic lock 81 and the second magnetic lock 82 are aligned in the collapsed position and magnetically attracted to each other to releasably hold the frame 20 in the collapsed position.

To use the archery backstop 10, a user first pulls or rotates the first side member 21 away from the second side member 22 to overcome the magnetic coupling of the first and second magnetic locks 81, 82. Once fully rotated or unfolded, the user then rotates the switch 6 of the locking mechanism 5 to secure the switch 6 in the clip 7, securing the frame 20 in an open or unfolded position as shown in FIGS. 1A, 2.

Next, the user inserts both the first and second portions 51, 52 of the front board 50 as well as the first and second portions 61, 62 of the rear board 60 through the opening 27 formed in the upper portion of frame 20. The front board 50 should be arranged in front of the rear board 60, meaning that the front board 50 should be facing in the same direction that the hooks 77 extend from the first and second support bars 71, 72.

Alternatively, as shown in FIG. 8, each portion 51, 52, 61, 62 of the front and rear boards 50, 60 may be inserted in the frame 20 when in the collapsed position. When in the collapsed position, the terminal ends of the upper and lower frame members 23, 24 are open and able to receive the portions 51, 52, 61, 62 of the front and rear boards 50, 60 therein by sliding each portion 51, 52, 61, 62 within the frame 20 in a direction from the hinges 28, 29 and toward the magnetic locks 81, 82. As explained hereinabove, the front board 50 and the rear board 60 may be variably positioned in the frame 20 by inserting a locking pin through apertures formed in both the front and the rear boards 50, 60 and the first and second side members 21, 22, if desired.

With continuing reference to FIGS. 1A, 3, and 4A the user then positions the frame 20 such that the first side member 21 is received in the first portion 31 of the first support 30 and the second side member 22 is received in the first portion 31 of the second support 40. The user then inserts the thumb knobs 36 through the apertures 35 formed in the first portion 31 of each support 30, 40. As described hereinabove, the apertures 35 and the thumb knobs 36 have cooperating threads formed thereon, allowing the thumb knobs 36 to be threaded into the apertures 35 and toward the frame 20, causing the thumb knobs 36 to apply pressure to the frame 20 to maintain a position of the frame 20 relative to each of the first and second supports 30, 40. Alternatively, the thumb knobs 36 may be received in apertures (not shown) formed in the first and second side members 21, 22 to secure the frame 20 to the first and second supports 30, 40. Additionally, the thumb knobs 36 may be used to hold the position of a target to be mounted on the archery backstop 10, as desired.

With reference to FIGS. 5-7, and 10-11, the user inserts the first and second support tubes 91, 92 into the third portion 33 of each respective first and second support 30, 40 to add additional support to the archery backstop 10. A plurality of locking pins (not shown) are inserted through the apertures 37 of the third portion 33 and the apertures 93 of the first and second support tubes 91, 92 to secure the first and second support tubes 91, 92 to the first and second supports 30, 40. Next, the user may optionally insert a plurality of retaining devices through the apertures 95 formed in the upper and lower walls of the third portions 33 to secure the first and second supports 30, 40 to the ground surface.

Figure 13:
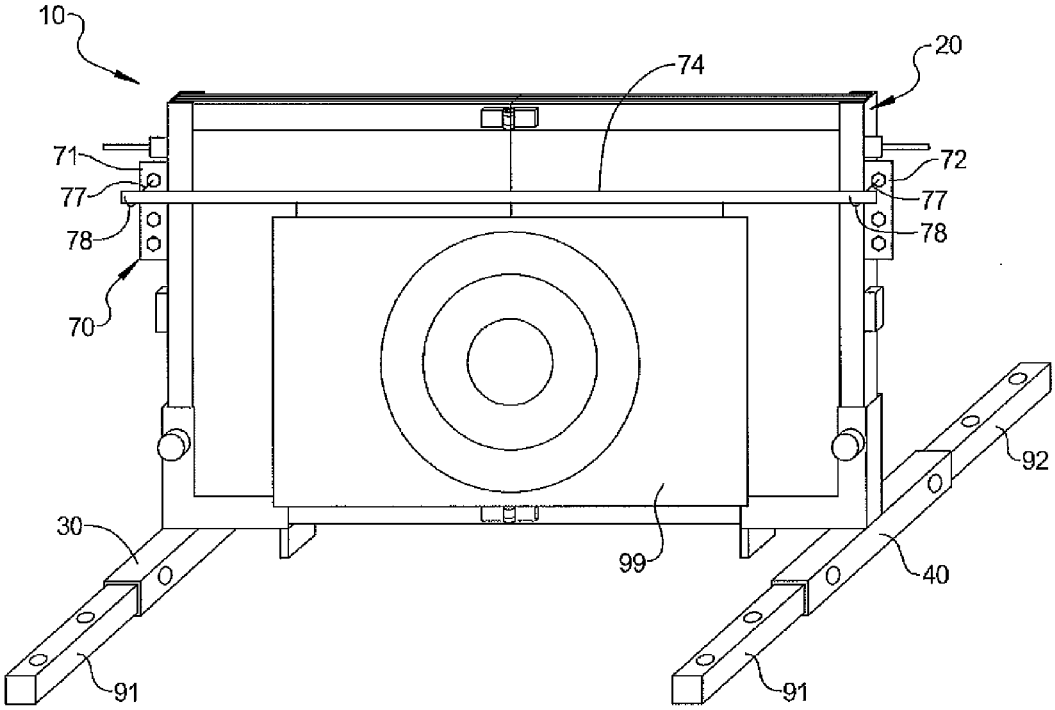
FIG. 13 is a perspective view of the archery backstop having a target mounted thereto and ready for use in target shooting.

Referring to FIG. 13, the archery backstop 10 is then ready for a target 99 to be secured thereto. The target 99 may be secured to the front board 50 or the target may be secured to the frame 20. As previously discussed herein, the target 99 may be attached to the archery backstop 10 using the thumb knobs 36 that are fed through the apertures 35 formed in the first portions 31 of the first support 30 and the second support 40. Alternatively, the user may insert the hooks 77 into the first and second bar supports 71, 72. The user then places the bar 74 in the retaining end 78 of each hook 77. The bar 74 may then be used to hang the target 99 using any form of known retaining means or connector, as shown in FIG. 13. For example, the bar 74 may have at least one connector attached thereto, in the form of a hook, clip, or other suitable means, for removably attaching the target 99 to the bar 74. Advantageously, the target 99 then hangs in front of the frame 20 and the front board 50 of the archery backstop 10, the first and second bar supports 71, 72 and the partial loop-shape of the retaining ends 78 of each of the hooks 77 permitting horizontal spacing of the target 99 on the frame. By changing a vertical position of the hooks 77 with respect to the first and the second bar supports 71, 72, a vertical position of the bar 74 and thereby a vertical position of the target 99 can be adjusted or changed.

After use, the user may first remove the target 99, the bar 74, and all locking pins and retaining devices to uncouple the first and second supports 30, 40 from both the ground surface and the frame 20. The user may also optionally remove each hook 77 from the first and second bar supports 71, 72 if the bar 74 is used. Next, the user may return the frame 20 to the collapsed position by rotating the switch 6 of the locking mechanism 5 to remove the switch 6 from the clip 7, allowing the frame 20 to be folded about the upper and lower hinges 28, 29. The first and second magnetic locking devices 81, 82 are then caused to be attracted to each other when in close proximity, causing the frame 20 to remain in the collapsed position until the user wishes to use the archery backstop 10 again.

The archery backstop 10 advantageously allows a user to collapse the archery backstop 10 for ease of transport. Furthermore, the archery backstop 10 is easily assembled and disassembled, saving the user considerable time and potentially frustration. The use of the front board 50 and the rear board 60 allows the archery backstop 10 to prevent the loss of arrows and the incidence of accidents associated with practicing archery, as well being able to capture filed-tipped arrows without damaging the arrows or the vanes, even when the arrows are shot with forces up to 30 lbs and from distances as close as 5 yards from the archery backstop 10.

The archery backstop 10 of the present disclosure is therefore available as a kit with multiple parts or components configured to connect to each other. The kit includes a frame used to slidably receive at least one board therein. The kit further includes a pair of bar supports extending outwardly from and coupled to the frame. The kit also includes a bar supported by and between the bar supports and has at least one connector for releasably holding an archery target in front of the frame. A pair of magnetic locking devices are provided that cooperate to secure the frame in a collapsed position for transport. A locking mechanism is also provided for securing the frame in an open position for use.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. An archery backstop comprising:

a frame having an open position in which the frame is used to receive at least one board therein and a closed position in which the frame is folded upon itself for transport, the frame having a first half portion and a second half portion, each of the first half portion and the second half portion having an upper frame member and a lower frame member connected by a side member, a pair of hinges positioned between the first half portion and the second half portion allowing rotation of the first and second half portions relative to each other from the closed position to the open position, the pair of hinges including an upper hinge attached to each of the upper frame members and a lower hinge attached to each of the lower frame members, the frame having a pair of magnetic locking devices coupled to the frame that cooperate to releasably secure the frame in the closed position, the magnetic locking devices including a first magnetic lock connected to the side member of the first half portion, and a second magnetic lock connected to the side member of the second half portion, the first and second magnetic locks attracted to each other when brought in alignment and closed proximity where the frame is in the closed position, and the frame having a locking mechanism to releasably secure the frame in the open position, the locking mechanism disposed on a side of the frame opposite the upper hinge and used to selectively secure the upper frame members of the first half portion and the second half portion in the open position; and a pair of bar supports extending outwardly from and coupled to the frame; and a bar disposed between the bar supports and having at least one connector for holding and adjusting a position of an archery target on the bar and in front of the frame.

2. The archery backstop of claim 1, wherein the at least one board includes a front board and a rear board.

3. The archery backstop of claim 2, wherein the front board is formed from medium density fiberboard and the rear board is formed from an extruded polystyrene insulation.

4. The archery backstop of claim 1, wherein the frame further includes at least one carrying handle releasably coupled thereto.

5. The archery backstop of claim 1, wherein the frame is supported by a first frame support and a second frame support, and each of the first frame support and the second frame support includes a channel formed therein that receives the frame.

6. The archery backstop of claim 1, wherein the locking mechanism includes a rotatable switch that is retained in a clip disposed on the frame.

7. A kit for an archery backstop, comprising:

a frame configured to receive at least one board therein, the frame having an open position in which the frame is used to receive at least one board therein and a closed position in which the frame is folded upon itself for transport, the frame having a first half portion and a second half portion, each of the first half portion and the second half portion having an upper frame member and a lower frame member connected by a side member, a pair of hinges positioned between the first half portion and the second half portion allowing rotation of the first and second half portions relative to each other from the closed position to the open position, the pair of hinges including an upper hinge attached to each of the upper frame members and a lower hinge attached to each of the lower frame members, the frame having a pair of magnetic locking devices coupled to the frame that cooperate to releasably secure the frame in the closed position, the magnetic locking devices including a first magnetic lock connected to the side member of the first half portion, and a second magnetic lock connected to the side member of the second half portion, the first and second magnetic locks attracted to each other when brought in alignment and closed proximity where the frame is in the closed position, and the frame having a locking mechanism to releasably secure the frame in the open position, the locking mechanism disposed on a side of the frame opposite the upper hinge and used to selectively secure the upper frame members of the first half portion and the second half portion in the open position;

a pair of bar supports configured to be extended outwardly from and be coupled to the frame; and a first frame support and a second frame support, each of the first frame support and the second frame support having a channel formed therein that is configured to receive the frame.

8. The kit for an archery backstop of claim 7, further including a bar configured to be positioned between the bar supports, the bar having at least one connector for holding the archery target in front of the frame and to permit horizontal position adjustment of the archery target.

* * * * *